US005329065A

United States Patent [19]

Marney et al.

[11] Patent Number: 5,329,065

[45] Date of Patent: Jul. 12, 1994

[54] ELECTRICAL CABLE

[75] Inventors: Derek Marney, Kirkheaton; David Hardy, Wakefield, both of United Kingdom

[73] Assignee: Litetronics (U.K.) Ltd., United Kingdom

[21] Appl. No.: 962,809

[22] PCT Filed: Jun. 14, 1991

[86] PCT No.: PCT/GB91/00956

§ 371 Date: Dec. 21, 1992

§ 102(e) Date: Dec. 21, 1992

[87] PCT Pub. No.: WO92/00592

PCT Pub. Date: Jan. 9, 1992

[30] Foreign Application Priority Data

Jun. 23, 1990 [GB] United Kingdom ..... 9014024

[51] Int. Cl.[5] ..... H01B 7/00

[52] U.S. Cl. ..... 174/128.1; 174/113 R; 174/115; 174/116

[58] Field of Search ..... 174/34, 112, 113 R, 174/115, 116, 110 R, 128.1

[56] References Cited

U.S. PATENT DOCUMENTS

| | | | |
|---|---|---|---|
| 2,286,826 | 6/1942 | Morrison | 174/116 |
| 2,958,724 | 11/1960 | Milloit | 174/34 X |
| 3,614,300 | 10/1971 | Wilson | 174/115 |
| 3,710,009 | 1/1973 | Hoeg et al. | 174/113 R X |
| 4,543,448 | 9/1985 | Deurloo | 174/115 X |
| 4,657,342 | 4/1987 | Bauer | 174/115 |

FOREIGN PATENT DOCUMENTS 871044 3/1941 France .

*Primary Examiner*—Morris H. Nimmo
*Attorney, Agent, or Firm*—Harrison & Egbert

[57] ABSTRACT

A multi-core electrical cable for use in the supply of electricity to certain electrical devices such as vapor lamps and the like comprises a molded-on outer sheath and at least two separately insulated inner core cables. At least one of the core cables has a high tension conducting core with an overall cross-sectional area of at least 1 mm square. Preferably, the high tension conducting core comprises a bundle of at least 32 strands of 0.2 mm diameter tinned copper wire with an insulating sheath which is at least 1.8 mm thick. The molded-on outer sheath of the multi-core cable preferably totally encapsulates the inner cables to a depth of at least 1.3 mm.

5 Claims, 2 Drawing Sheets

ELECTRICAL CABLE

TECHNICAL FIELD

The present invention relates to an electrical cable or flex and in particular to a high voltage electrical cable.

BACKGROUND ART

In the supply of electricity to certain electrical devices it is often necessary for the cable or flex used to withstand an initial high electrical voltage which is used to commence operation of the device, which thereafter runs on a standard mains voltage. For example, in order to strike a mercury vapour lamp or other similar lighting means, it is necessary to supply an initial voltage of approximately 4,500 volts. If a standard 3-core 13 amp electrical cable is used to supply this voltage, the cable can cope initially but quickly becomes burnt out with repeated use. There is also a significantly increased risk of fire.

To overcome the problem of supplying an initial high voltage to devices, such as lamps, which then run on a standard mains voltage, a heavy gauge single core insulated cable is often used as the live wire of the electrical supply along with separate standard single core neutral and earth wires. When wiring such a device to a mains electric supply these three wires are often pulled into a hollow sheath or tubular casing by the electrician so that the resulting single flex can be threaded, as appropriate, down a conduit between the electrical supply and the location of the device. However, it will be appreciated that this considerably increases the work required by the electrician as compared with the wiring of a device capable of being supplied by a standard 3-core cable. In addition, the sheathing of the three separate wires in the outer casing is often difficult to accomplish satisfactorily as the casing tends to twist and wrinkle.

The object of the present invention is to overcome or substantially mitigate the aforementioned problems.

SUMMARY OF THE INVENTION

According to the present invention there is provided a multi-core electrical cable comprising a moulded-on outer sheath, at least two separately insulated inner core cables and a separately insulated earth cable and characterised in that at least one of the inner core cables has a high tension conducting core with an overall cross-sectional area of at least 1 $mm^2$ and an insulating sheath which is approximately 1.8 mm thick, and in that the earth cable has a conducting core with an overall cross-sectional area of at least 1 $mm^2$ and an insulating sheath which is approximately 0.65 mm thick.

Preferably, the high tension conducting core comprises a bundle of at least 32 strands of 0.2 mm diameter tinned copper wire.

Preferably also, the moulded-on outer sheath of the multi-core cable totally encapsulates the inner core cables and the earth cable to a depth of at least 1.3 mm.

Preferably also, the inner core cables and the earth cable are twisted together within the moulded-on outer sheath and bound by a spirally wound tape.

BRIEF DESCRIPTION OF THE DRAWINGS

The present invention will now be described by way of example with reference to the accompanying drawing, in which.

DETAILED DESCRIPTION OF THE INVENTION

Figure 1:
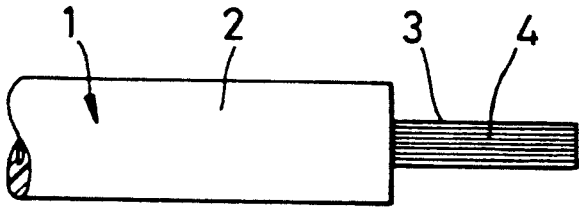
FIGS. 1 and 1*a* are side and end views respectively of a high tension core cable for incorporation into a multi-core cable according to the invention.
Figure 1A:
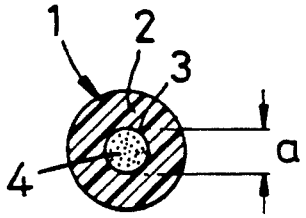

The multi-core cable of the present invention comprises at least one inner core cable 1, as shown in FIG. 1 and 1*a*, which is capable of withstanding a high voltage, preferably of at least 4,500 volts.

This cable 1 comprises an insulating sheath 2 encapsulating an inner conducting core 3 which is made up of a bundle of individual wires 4. Preferably, each wire 4 is a tinned copper wire of approximately 0.2 mm diameter so that the overall cross-sectional area of the conducting core 3 is approximately 1 $mm^2$.

The insulating sheath 2 encapsulates the core 3 to a depth "a" of at least 1.8 mm as shown in FIG. 1*a* and is preferably made from a PVC compound which complies with British Standard BS6746. However, any other suitable insulating material could be used, such as for example silicone or rubber, provided that it can withstand a high electrical voltage. In this case, the depth of the encapsulation of the core 3 by the sheath 2 may be different according to the material used.

Figure 2:
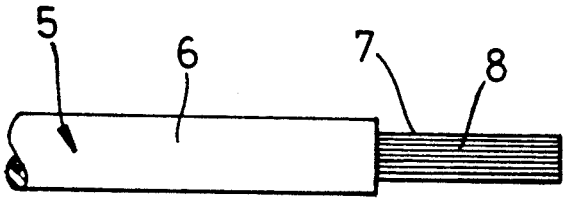
FIGS. 2 and 2*a* are side and end views respectively of an earth safety core cable for incorporation into a multi-core cable according to the invention.
Figure 2A:
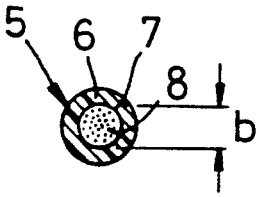

FIGS. 2 and 2*a* show a safety earth cable 5 for incorporation in a multi-core cable according to the invention and comprising a high tension core cable as shown in FIGS. 1 and 1*a*. The cable 5 again comprises an insulating sheath 6 encapsulating an inner conducting core 7. As with the high tension cable 1, the core 7 of the cable 5 is made from a bundle of individual wires 8 and again these comprise 32 tinned copper conducting wires of 0.2 mm diameter. However, the depth of the insulating sheath 6 encapsulating the core 7 need not be so great as that for the cable 1 as the earth cable 5 is intended to withstand a high voltage only in exceptional circumstances. Here, the sheath 6 has a depth "b" of 0.65 mm surrounding the core 7 and it is made from the same PVC material as the sheath 2.

A multi-core cable according to the invention suitable for use in supplying an electrical current to a mercury vapour lamp or similar where it will have to withstand an initial voltage of the order of 4,500 volts preferably comprises three cores, as in a standard electrical cable or flex, but with the live and neutral core cables being high tension cores of the kind described above with reference to FIGS. 1 and 1*a* and the safety earth core cable being of the kind described with reference to FIGS. 2 and 2*a*. The construction of such a cable will now be described with reference to FIGS. 3 to 6.

Figure 3:
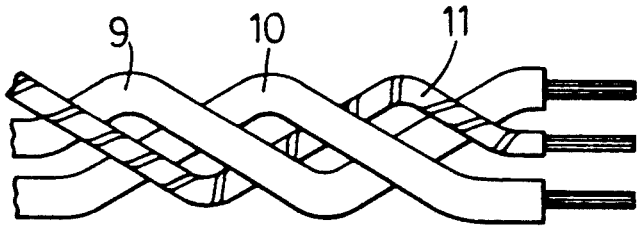
FIGS. 3 and 4 are side views of three core cables forming part of a multi-core cable according to the invention at two stages respectively during its manufacture.
Figure 4:
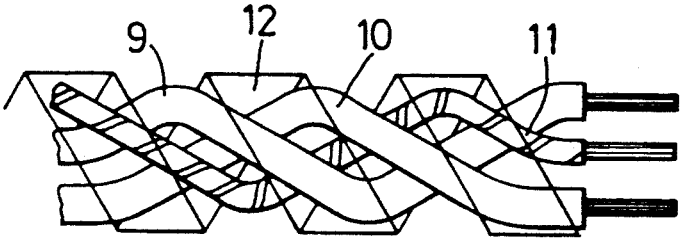

In the manufacture of such a three-core cable, the high tension live and neutral cables 9 and 10 respectively and an earth cable 11 are individually manufactured in known manner to the specifications previously described and they are then lightly twisted together as shown in FIG. 3. Preferably, to aid the identification of each of the cables 9, 10 and 11 for wiring purposes, the insulating sheath of each is individually coloured in line with International Standards.

Figure 5:
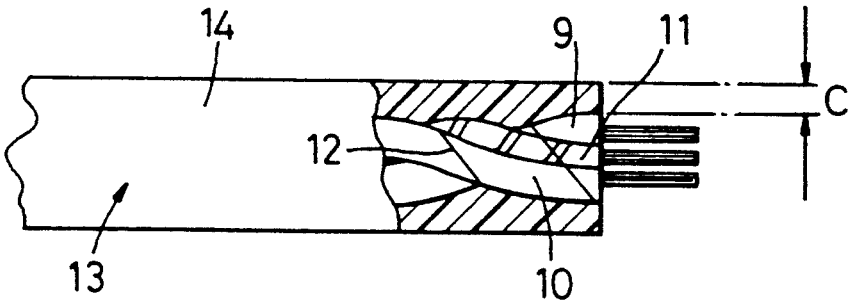
FIG. 5 is a side view of a multi-core cable according to the invention with part of its outer sheath cut away to reveal the core cables.
Figure 6:
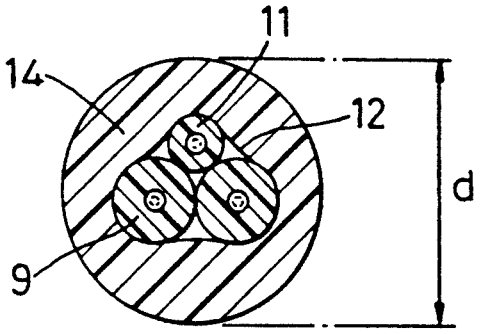
FIG. 6 is a transverse cross-sectional view of the cable shown in FIG. 5.

After twisting, the bundle of cables 9, 10, 11 is secured by the application of tape 12, which is wound spirally around the bundle of twisted cables 9, 10, 11. The tape 12 is clear so that the colours of the sheaths of the cables 9, 10 and 11 can be seen if the finished multi-core cable 13, as shown in FIGS. 5 and 6, is cut into. Additionally, the tape 12 is also made from an electrically insulating and heat resisting material.

Finally, the taped and twisted cables 9, 10 and 11 are completely enclosed in known manner in a moulded-on sheath 14 which can be made of a similar PVC compound as that of the individual sheaths comprising the cables 9, 10, 11. The sheath 14 encapsulates the twisted bundle of cables 9, 10, 11 to a depth "c" of at least 1.3 mm and also insulates each of the cables from one another so that the finished structure of the cable 13, as shown in FIG. 6, is solid. The overall diameter "d" of the cable 13 is of the order of 12.5 mm.

Such a multi-core cable 13 is suitable for use in many situations and particularly in lighting installations where a high voltage of up to 4,500 volts has to applied to an electrical device. However, it will be appreciated that many different configurations of cable are possible depending on their intended use. Cables with 1, 2, 3, 5 and more inner high tension inner core cables are all possible and can be manufactured in a similar way to that described above for use in a variety of applications where high voltages must be withstood.

We claim:

1. A multi-core electrical cable comprising a moulded-on outer sheath, at least two separately insulated inner core cables and a separately insulated earth cable, at least one of the inner core cables has a high tension conducting core with an overall cross-sectional area of at least 1 $mm^2$ and an insulating sheath which is approximately 1.8 mm thick, and wherein said earth cable has a conducting core with an overall cross-sectional area of at least 1 $mm^2$ and an insulating sheath which is approximately 0.65 mm thick.

2. The cable as claimed in claim 1, said high tension conducting core comprises a bundle having at least 32 strands of 0.2 mm diameter tinned copper wire.

3. The cable as claimed in claim 1, said moulded-on outer sheath of the multi-core cable totally encapsulates the inner core cables and said earth cable to a depth of at least 1.3 mm.

4. The cable as claimed in claim 1, said inner core cables and said earth cable are twisted together within said moulded-on outer sheath and bound by a spirally wound tape.

5. The cable as claimed in claim 1 comprising at least two separately insulated high-tension conducting cores.

* * * * *